United States Patent [19]

Leppänen

[11] Patent Number: 4,716,794

[45] Date of Patent: Jan. 5, 1988

[54] OPENING DEVICE FOR AN EXTENSION ROD DRILLING EQUIPMENT

[75] Inventor: Jarmo Leppänen, Ylöjärvi, Finland

[73] Assignee: OY Tampella AB, Tampere, Finland

[21] Appl. No.: 911,810

[22] Filed: Sep. 26, 1986

[30] Foreign Application Priority Data

Oct. 22, 1985 [FI] Finland ..... 854119

[51] Int. Cl.[4] ..... B25B 17/00

[52] U.S. Cl. ..... 81/57.18; 279/71

[58] Field of Search ..... 81/57.18, 128; 279/71, 279/81

[56] References Cited

U.S. PATENT DOCUMENTS

| | | | |
|---|---|---|---|
| 420,016 | 1/1890 | McCool | 279/71 |
| 1,180,667 | 4/1916 | Martin | 279/71 |
| 3,371,562 | 3/1968 | Kelley | 81/57.18 |

*Primary Examiner*—Frederick R. Schmidt
*Assistant Examiner*—Judy J. Hartman
*Attorney, Agent, or Firm*—Nixon & Vanderhye

[57] ABSTRACT

An opening device for an extension rod drilling equipment, comprising a supporting sleeve (3) rotatably mounted in a frame (1), and gripping jaws (6) displaceably mounted in the sleeve for gripping a drill rod. In order to allow the device to both grip the drill rod and rotate it, the supporting sleeve is connected to a rotating mechanism (14) and provided with cylindrical guideways (4, 5) positioned eccentrically with respect to the axis (A) of the sleeve in such a manner that a rotating movement of the sleeve with respect to the gripping jaws causes a displacement of the gripping jaws towards an aligned rod releasing position and away from the aligned position respectively, depending on the direction of rotation of the supporting sleeve.

3 Claims, 13 Drawing Figures

OPENING DEVICE FOR AN EXTENSION ROD DRILLING EQUIPMENT

Figure 1:
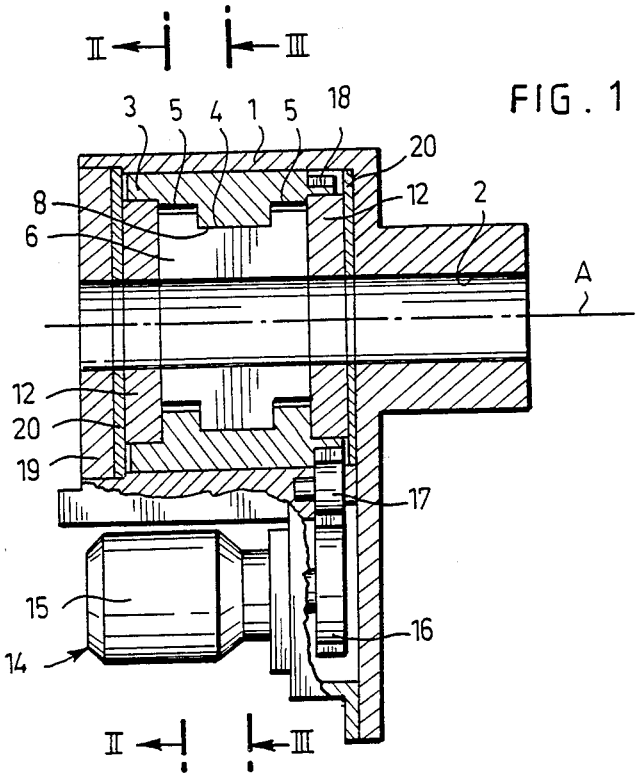

This invention relates to an opening device for an extension rod drilling equipment, which centralizer comprises a frame, a supporting sleeve provided with a through hole for a drill rod and mounted rotatably on said frame, gripping means mounted displaceably in the supporting sleeve for gripping the drill rod, and means for displacing the gripping means towards and away from each other.

In mechanized extension rod drilling, a retaining centralizer is used for guiding the drill rod when starting the drilling process and for retaining the drill rod when opening the drilling machine or the drill rod. The retaining centralizer is positioned at the opposite end of the feeding beam with respect to the drilling machine. Besides the retaining centralizer, a separate rod rotating mechanism connected to the feeding beam has to be provided outside the feeding beam. A rod positioned on the feeding beam can be rotated to disconnect from the rod retained unrotating by the retaining centralizer by displacing the rotating mechanism to the drilling centre and by gripping the drill rod therewith.

A separate retaining centralizer and rotating mechanism require plenty of room and are heavy. Numerous operational means make the operation and structure complicated and slow.

Finnish Patent Specification No. 66,052 discloses an opening device for extension rods which is intended to be connected rotatably but axially stationarily to the drilling machine. The opening device is provided with gripping means which are displaceable between a gripping position and a releasing position when a supporting sleeve is moved axially with respect to a frame by means of a hydraulic cylinder. A disadvantage of this opening device is that the device must be connected to the drilling machine and that the opening device requires the use of a conventional retaining centralizer at the end of the feeding beam.

The object of the present invention is to provide an opening device which avoids the above-mentioned disadvantages and which is able to operate as an independent unit for retaining and opening drill rods. This object is achieved by means of a retaining centralizer according to the invention which is characterized in that the supporting sleeve is connected to a rotating mechanism for the rotation of the sleeve around an axis of the through hole, and that the supporting sleeve is provided with guideways for the gripping means, said guideways being arranged so that a rotating movement of the supporting sleeve with respect to the gripping means effects a displacement of gaps of the gripping means away from an aligned rod releasing position and correspondingly towards the aligned position, depending on the direction of rotation of the supporting sleeve.

The invention is based on the idea that the retaining centralizer and the rotating mechanism are combined to obtain an opening device in which it is possible to utilize the rotatory movement not only for the rotation of the gripping means of the device for the opening of the drill rods but also for the displacement of the gripping means between the rod gripping position and the rod releasing position. The opening device can be mounted at the end of the feeding beam of the drilling machine in place of a prior unrotating retaining centralizer. The structure is simple, light, and easy to use, because it comprises several simultaneous operations.

Figure 3:
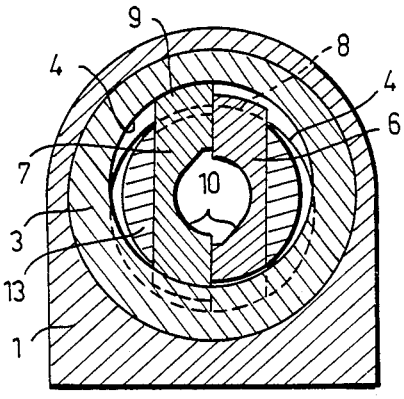
Figure 2:
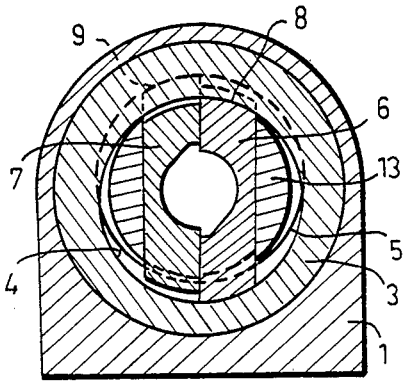
Figure 4:
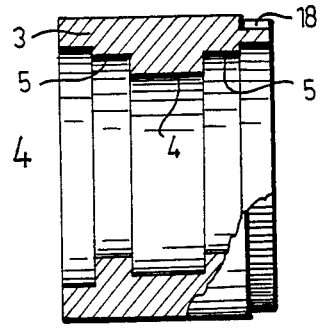
Figure 5:
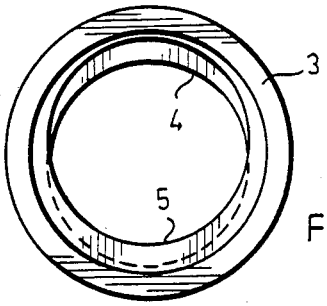
Figure 6:
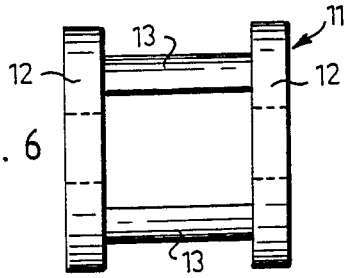
Figure 7:
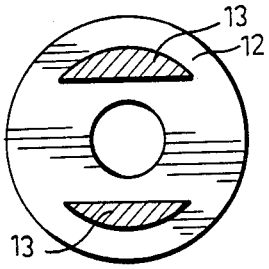
Figure 8:
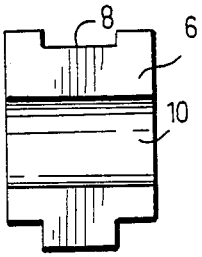
Figure 9:
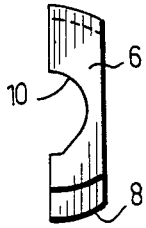
Figure 10:
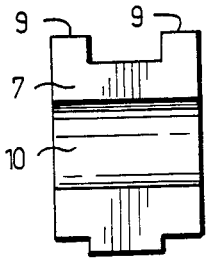
Figure 11:
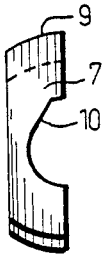
Figure 12:
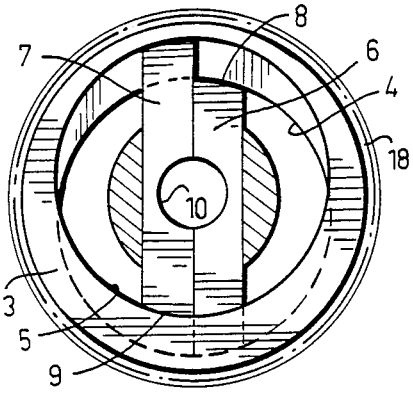
Figure 13:
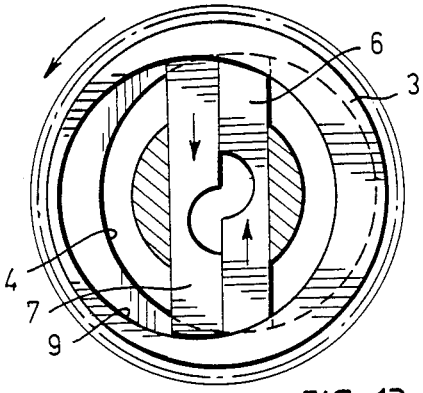

The invention will be described in more detail below with reference to the attached drawings, wherein FIG. 1 is an axial sectional view of one preferred embodiment of an opening device according to the invention, FIGS. 2 and 3 are sections along the lines II—II and III—III respectively of FIG. 1, FIGS. 4 and 5 are a partial axial section and a top view respectively of the supporting sleeve of the device, FIGS. 6 and 7 are a side and a cross-sectional view respectively of the supporting fork of the device, FIGS. 8 and 9 and correspondingly FIGS. 10 and 11 are an inner and a top view respectively of both gripping means of the device, and FIGS. 12 and 13 illustrate schematically the operational idea of the opening device according to the invention in a releasing and a gripping position respectively.

The opening device shown in FIG. 1 of the drawings is intended to be mounted on a feeding beam of an extension rod drilling equipment at the rock side end of the feeding beam.

The opening device comprises a frame 1 provided with a through hole 2 and intended to be fastened on the feeding beam in such a manner that the axis A of the hole joins the drilling axis of the feeding beam. A supporting sleeve 3 is rotatably mounted on the frame in such a manner that the hole of the sleeve is coaxial with the hole 2 of the frame. The supporting sleeve forms two cylindrical guideways 4, 5 the axes of which are parallel with the axis A of the supporting sleeve and which nevertheless are eccentrically positioned on opposite sides of the axis, as appears from FIGS. 4 and 5 in particular.

The opening device further comprises two gripping means formed by plate-like jaws 6 and 7. The outer surfaces of the jaws are provided with cylindrical surfaces corresponding to the guideways 4, 5 of the supporting sleeve, whereby the jaw 6 is provided with a guide surface 8 corresponding to the guideway 4, and the other jaw is provided with guide surfaces 9 corresponding to the guideway 5, as appears from FIGS. 8 to 11 in particular. One planar surface of the jaws is provided with a semicylindrical gripping gap 10 which is eccentrically positioned with respect to the guide surface of the jaw in such a manner that when the planar surfaces of the jaws are positioned against each other, the gaps are positioned either in alignment or displaced with respect to each other, depending on whether the guide surfaces 8, 9 of the jaws are displaced with respect to each other or in alignment with each other.

A supporting fork 11 is pivotably mounted within the supporting sleeve and provided with cylindrical end plates 12 and arms 13 positioned therebetween. The distance between the arms 13 of the fork corresponds to the thickness of the pair of jaws so that the jaws are slideable between the arms. The arms are intended to keep the jaws pressed against each other.

The device further comprises a rotating mechanism 14 comprising a hydraulic motor 15 secured to the frame of the device. A coggwheel 16 fastened to the hydraulic motor is in engagement with an intermediate coggwheel 17 which is mounted on the frame and which, in turn, is in engagement with an external tooth rim 18 formed on the supporting sleeve.

The frame is closed by a cover 19, and friction plates 20 are provided between said cover and the end of the supporting fork as well as between the inner end of the frame and the opposite end of the supporting fork.

The opening device operates in the following way:

When drilling a rock, the drill rod extends through the hole 2 of the frame. When the supporting sleeve is rotated to such a position with respect to the jaws that the gaps of the jaws are in alignment in a manner shown in FIG. 12, the jaws are out of engagement with the drill rod. The drill rod is thus able to rotate freely within the opening device.

When the tooth rim of the supporting sleeve is rotated by the hydraulic motor, the friction plates tends to prevent the supporting fork and, consequently, the jaws, from rotating with the supporting sleeve. As a result thereof, the eccentric guideways of the supporting sleeve press the jaws towards each other in the direction of their common division plane so that the gaps of the jaws are displaced away from each other as shown in FIG. 13. The drill rod is thereby centered to the drilling axis., i.e. to the axis A of the frame, and finally locked for rotation with the supporting sleeve. The supporting fork controls the sliding of the jaws with respect to each other.

When the tooth rim of the supporting sleeve is rotated in the opposite direction, the eccentric guideways of the supporting sleeve press the jaws away from each other so that the gaps approach each other and the drill rod is released from the pressure of the jaws. The opening device thus acts merely as a retaining centralizer during the normal drilling operation. When the tooth rim is further rotated, the jaws are again displaced towards each other so that the drill is locked for rotation with the supporting sleeve.

It is noted that the opening device is able to operate both as a conventional retaining centralizer and as a rotating mechanism for the opening of the drill rod or the shank.

The required torque, by means of which the jaws are displaced to the fastening position and the drill rod starts to rotate with the opening device, is obtained by a desired tightening of the friction plates.

The drawings and the description related thereto are only intended to illustrate the idea of the invention. In its details, the opening device according to the invention may vary within the scope of the claims. It is possible to use other kinds of gripping means instead of the plate-like jaws, such as eccentric wheels or radial pistons displaceable between a fastening and a releasing position of the drill rod.

I claim:

1. An opening device for extension rod drilling equipment, comprising:

a frame;

a support sleeve having a central opening defining an axis and rotatably carried by said frame, said sleeve being adapted to receive a drill rod in said central opening;

gripping means carried by said sleeve for movement in a direction generally normal to said axis and having gripping surfaces for gripping the drill rod in the opening, said gripping means including a pair of jaws having substantially flat planar surfaces maintained in permanent slidable engagement with one another by the support sleeve, said gripping surfaces being defined by recesses in said planar surfaces;

means for rotating said sleeve about said axis;

said support sleeve having a pair of arcuate cam surfaces and said gripping means having a pair of cam follower surfaces for following engagement with said arcuate cam surfaces, respectively, said arcuate cam surfaces having discrete axes extending parallel to the axis of said central opening and positioned on opposite sides of said axis, respectively, whereby the axes of said arcuate cam surfaces are radially offset one from the other and from the axis of the central opening;

said cam surfaces engaging corresponding cam follower surfaces at diametrically opposite sides of said sleeve whereby rotation of said sleeve relative to said gripping means and in opposite directions moves said gripping surfaces respectively toward and away from positions wherein said gripping surfaces are aligned one with the other to grip the rod and misaligned one with the other to release the rod.

2. An opening device according to claim 1, including a support fork mounted for rotation relative to said support sleeve and connected with said gripping means to maintain said gripping surfaces pressed against one another, said gripping means being slidable within said fork in a direction normal to said axis while said fork maintains said gripping jaws pressed against each other.

3. An opening device according to claim 2, including friction plates mounted in said frame for pressing against said support fork to prevent said support fork and the gripping means from rotating relative to said support sleeve.

* * * * *